US009070310B2

(12) United States Patent
Spina et al.

(10) Patent No.: US 9,070,310 B2
(45) Date of Patent: Jun. 30, 2015

(54) SAFETY FRAME SYSTEM FOR AN LED SIGNAGE

(71) Applicant: TGI Systems Corporation, Chicago, IL (US)

(72) Inventors: Vince Spina, Chicago, IL (US); Chris J. Brennan, Chicago, IL (US); Jason Machiela, Chicago, IL (US); John Thomas Lawrence, II, Coto de Caza, CA (US)

(73) Assignee: TGI Systems Corporation, Chicago, IL (US)

( * ) Notice: Subject to any disclaimer, the term of this patent is extended or adjusted under 35 U.S.C. 154(b) by 0 days.

(21) Appl. No.: 14/244,269

(22) Filed: Apr. 3, 2014

(65) Prior Publication Data

US 2014/0298697 A1 Oct. 9, 2014

Related U.S. Application Data

(60) Provisional application No. 61/809,142, filed on Apr. 5, 2013.

(51) Int. Cl.
*G09F 13/04* (2006.01)
*G09F 9/33* (2006.01)

(52) U.S. Cl.
CPC .... *G09F 13/0413* (2013.01); *G09F 2013/0445* (2013.01); *G09F 9/33* (2013.01)

(58) Field of Classification Search
CPC ..... G09F 13/0413; G09F 2013/0045; G09F 15/0062
See application file for complete search history.

(56) References Cited

U.S. PATENT DOCUMENTS

| | | | | |
|---|---|---|---|---|
| 5,347,736 | A * | 9/1994 | Kanigan | 40/576 |
| 7,467,773 | B2 | 12/2008 | Ogawa et al. | |
| 8,266,834 | B2 | 9/2012 | Chen et al. | |
| 2005/0091894 | A1 * | 5/2005 | Hamilton et al. | 40/610 |
| 2007/0018061 | A1 | 1/2007 | Ogawa et al. | |
| 2008/0244944 | A1 * | 10/2008 | Nall et al. | 40/544 |
| 2014/0268786 | A1 * | 9/2014 | Quaal et al. | 362/249.08 |
| 2014/0290104 | A1 * | 10/2014 | Lindblom et al. | 40/559 |
| 2015/0096210 | A1 * | 4/2015 | Monti | 40/564 |

FOREIGN PATENT DOCUMENTS

| | | | |
|---|---|---|---|
| KR | 1020020092707 | A | 1/2007 |
| KR | 1020080057782 | A | 6/2008 |

OTHER PUBLICATIONS

Written Opinion of the International Searching Authority, Aug. 21, 2014, on corresponding PCT Application No. US2014/032947.

* cited by examiner

*Primary Examiner* — Gary Hoge
(74) *Attorney, Agent, or Firm* — Adam K. Sacharoff; Much Shelist

(57) ABSTRACT

An LED Signage system having an LED cabinet and top and bottom plates secured along the top and bottom of the cabinet, and each having a channel aligned towards each other configured to receive a safety screen to protect the LED screen. A base supports the bottom plate and has pairs of rearwardly and forwardly extending arms each with a roller. Rear hinges secure the bottom plate to the base, such that when a force impacts the system the cabinet is configured to move at the rear hinges from an upright position to a collapsed position. Pads are positioned along the top and/or rear of the cabinet and/or secured by front hinges to a front edge of the bottom plate to help protect the system if collapsed from an impact. The system may include a platform with tracks configured to support the base and rollers.

27 Claims, 10 Drawing Sheets

SAFETY FRAME SYSTEM FOR AN LED SIGNAGE

CROSS REFERENCE TO RELATED APPLICATIONS

The present application claims priority to U.S. Provisional Application 61/809,142 filed Apr. 5, 2013. All of which are incorporated herein by reference.

BACKGROUND OF THE INVENTION

The background of the invention relates to an LED Signage and the construction of a safety frame system for use therewith to help prevent injury when the LED Signage is impacted. Often times large LED Signage when in use can topple when impacted by a person or an object. To help prevent injury to the signage it would be beneficial to employ a safety frame system that secures the signage in an upright position, but will permit the signage to collapse when impacted by a force in a manner that helps prevents injury to persons or the signage.

There is thus a need to provide a safety frame system to allow an LED Signage to collapse.

SUMMARY OF THE INVENTION

One or more of the embodiments provided in the present invention relates to an LED Signage system. The LED signage system includes an LED cabinet having surfaces or portions defined along the top, bottom, rear and front of the cabinet. The LED cabinet further having an LED screen about the front portion. The LED Signage system further includes top and bottom support plates, respectively secured along the top and bottom portions of the cabinet. The top and bottom support plates each have a channel aligned towards each other and configured to support a safety screen. The bottom support plate and thus the cabinet are supported by a base frame. The base frame has forward and rear base edges to align with the edges along the bottom support place. The base frame further having a pair of rearwardly extending arms and a pair of forwardly extending arms. The rearward and forward extending arms each has a roller. In addition, the bottom support plate is secured to the base frame by rear hinges to allow the cabinet to hinge or pivot from an upright portion to a collapsed position such that when an force impacts the LED Signage system the cabinet is configured to move at the rear hinges from an upright position resting on the base frame to a collapsed position and wherein when moving to the collapsed position, the rear pads help reduce damage to the cabinet.

The LED Signage system may also include a platform having a pair of tracks. The platform is configured to support the base frame and the pair of tracks is configured to accommodate the rollers secured to the pair of rearwardly and forwardly extending arms.

In other aspects, the top support plate of the LED Signage system may include a top panel with a rear edge and a front edge, a rear panel depending from the rear edge, where the rear panel further has a plurality of top rear flanges extending downwardly therefrom, an upwardly tapered panel extending from the front edge of the top panel, an outwardly extending panel further extending from the upwardly tapered panel, and a pair of downwardly dependent front panels extending from the outwardly extending panel and spaced apart from each other a predetermined distance to form the top channel there between.

In yet other aspects, the bottom support plate of the LED Signage system may include a bottom panel having a rear bottom edge and a front bottom edge, a plurality of bottom rear flanges upwardly extending from the rear bottom edge of the bottom panel, an U-shaped bottom section positioned from the front bottom edge of the bottom panel, and configured to define the bottom channel, and a pair of notches separately configured along the U-shaped bottom section. The rearwardly extending arms may be separately positioned in the pair of notches that are configured along the U-shaped bottom section of the bottom support panel.

In yet other aspects of the invention, the LED Signage system may further include a safety shield positioned in the top and bottom channels front of the LED screen.

The LED Signage system of may also define the base frame as having a pair of longitudinal members extending the length of the bottom support plate and a pair of end members secured to the pair of longitudinal members to define a rectangular shaped based frame with the forward and rear base edges defined along the pair of longitudinal members. In this instance, the pair of rearwardly extending arms and the pair of forwardly extending arms are separately positioned towards the end members of the base frame.

Safety pads may be secured to the top support plate and/or the bottom support plate. When secured to the bottom support plate the base pad is preferably secured by a plurality of front hinges to a front edge of the bottom support plate.

In another embodiment of the present invention there is provided an LED Signage system having (a) an LED cabinet; (b) top and bottom support plates secured along top and bottom surfaces defined by the cabinet, the top and bottom support plates each have a channel aligned towards each other; (c) a safety screen received in the channels to protect a front surface of the LED cabinet; (d) a base frame supporting the bottom support plate and having pairs of rearwardly and forwardly extending arms, each arm having a roller thereon; (e) rear hinges secure the bottom support plate to the base frame; and (f) a platform with tracks configured to support the base frame and rollers, such that when an force impacts the system the cabinet is configured to move about the track and/or at the rear hinges from an upright position to a collapsed position. In other aspect of this embodiment, the LED Signage system may further include one or more pads positioned along the top support plate and/or positioned along a rear surface of the cabinet and/or secured by hinges to a front edge of the bottom support plate to help protect the system if collapsed from an impact.

Numerous other advantages and features of the invention will become readily apparent from the following detailed description of the invention and the embodiments thereof, from the claims, and from the accompanying drawings.

DESCRIPTION OF THE DRAWINGS

A fuller understanding of the foregoing may be had by reference to the accompanying drawings, wherein.

DETAILED DESCRIPTION OF THE EMBODIMENTS

Figure 1:
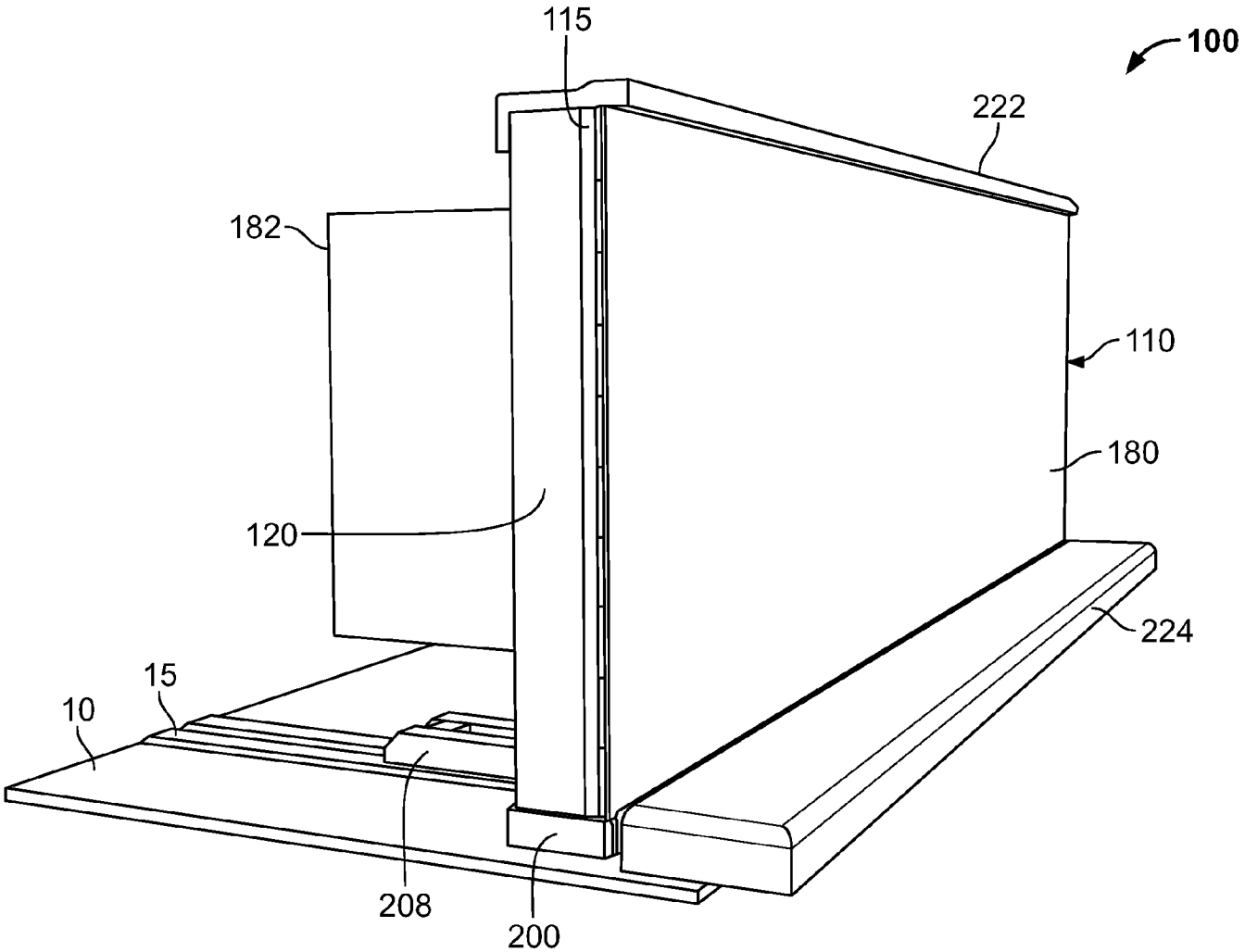
FIG. 1 is a perspective view of an LED Signage system in accordance with an embodiment of the invention.

While the invention is susceptible to embodiments in many different forms, there are shown in the drawings and will be described herein, in detail, the preferred embodiments of the present invention. It should be understood, however, that the present disclosure is to be considered an exemplification of the principles of the invention and is not intended to limit the spirit or scope of the invention and/or the embodiments illustrated.

Figure 2:
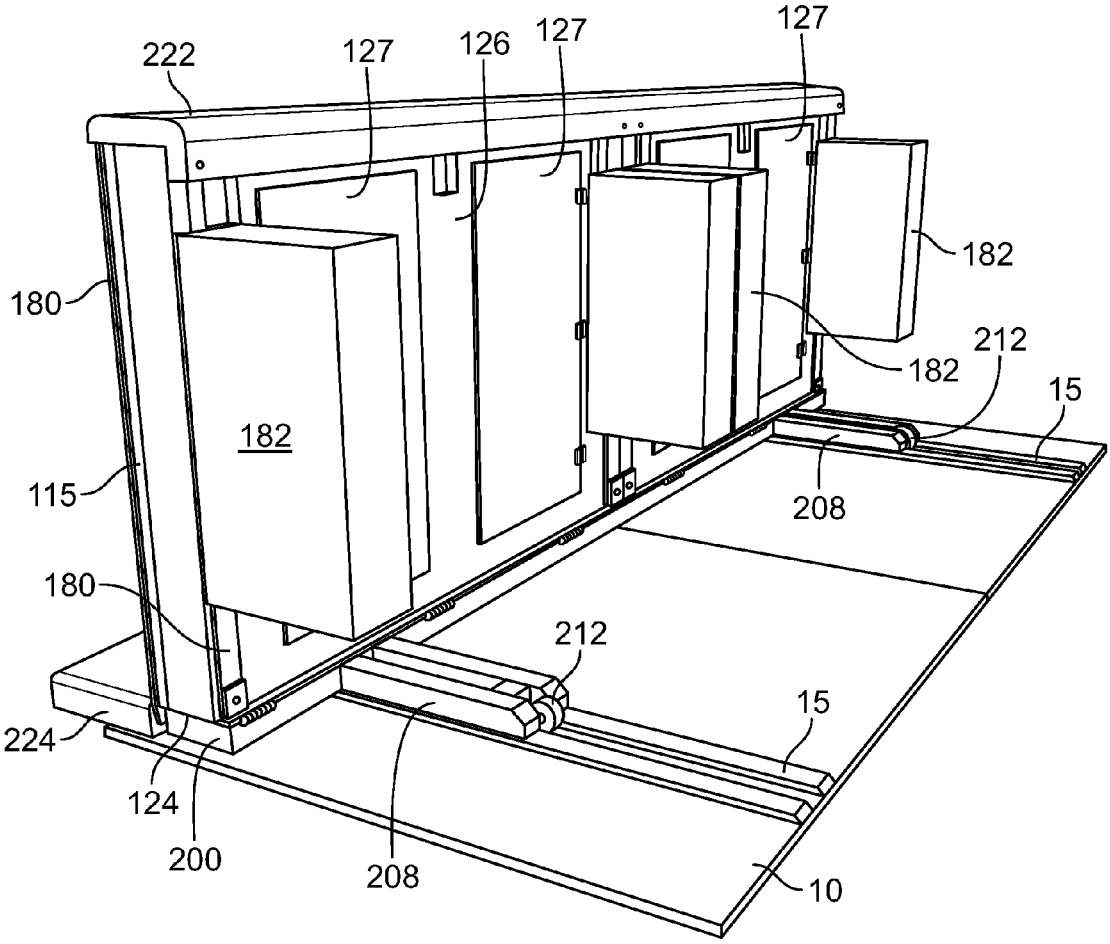
FIG. 2 is a rear perspective view of an LED Signage system in accordance with an embodiment of the invention.
Figure 3:
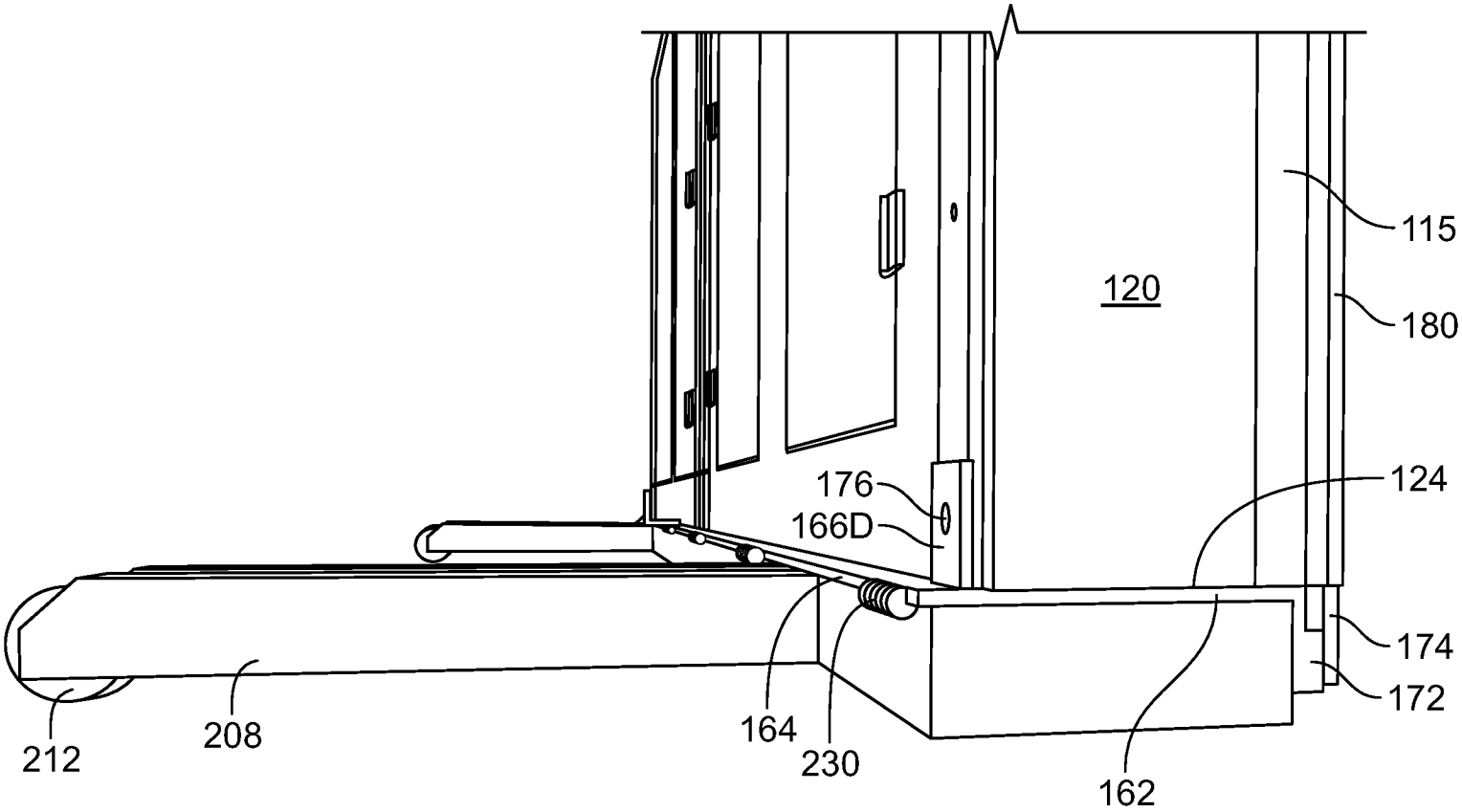
FIG. 3 is a partial side perspective view of an LED Signage system in accordance with an embodiment of the invention.
Figure 4:
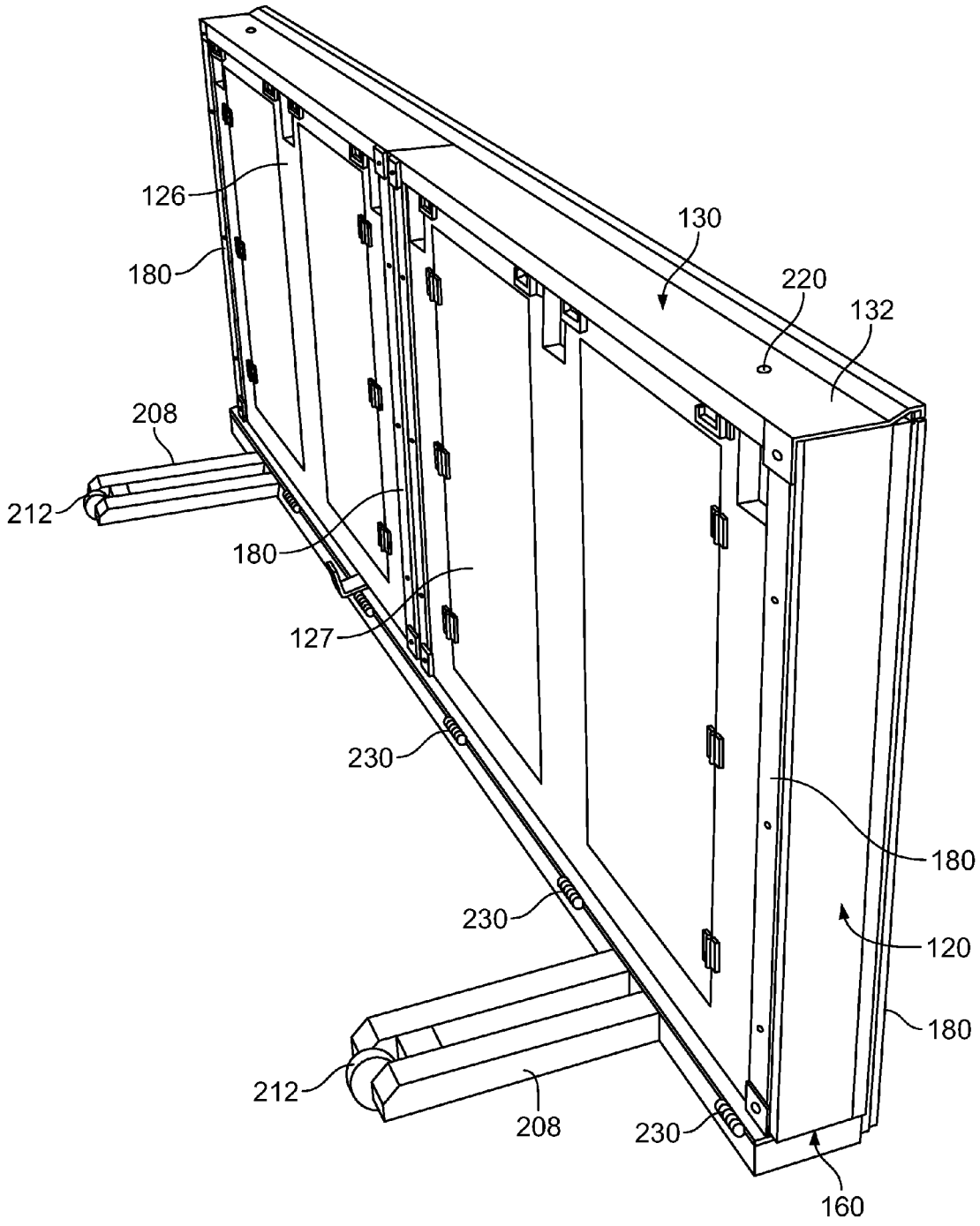
FIG. 4 is a perspective view of specific components of an LED Signage system in accordance with an embodiment of the invention.
Figure 5:
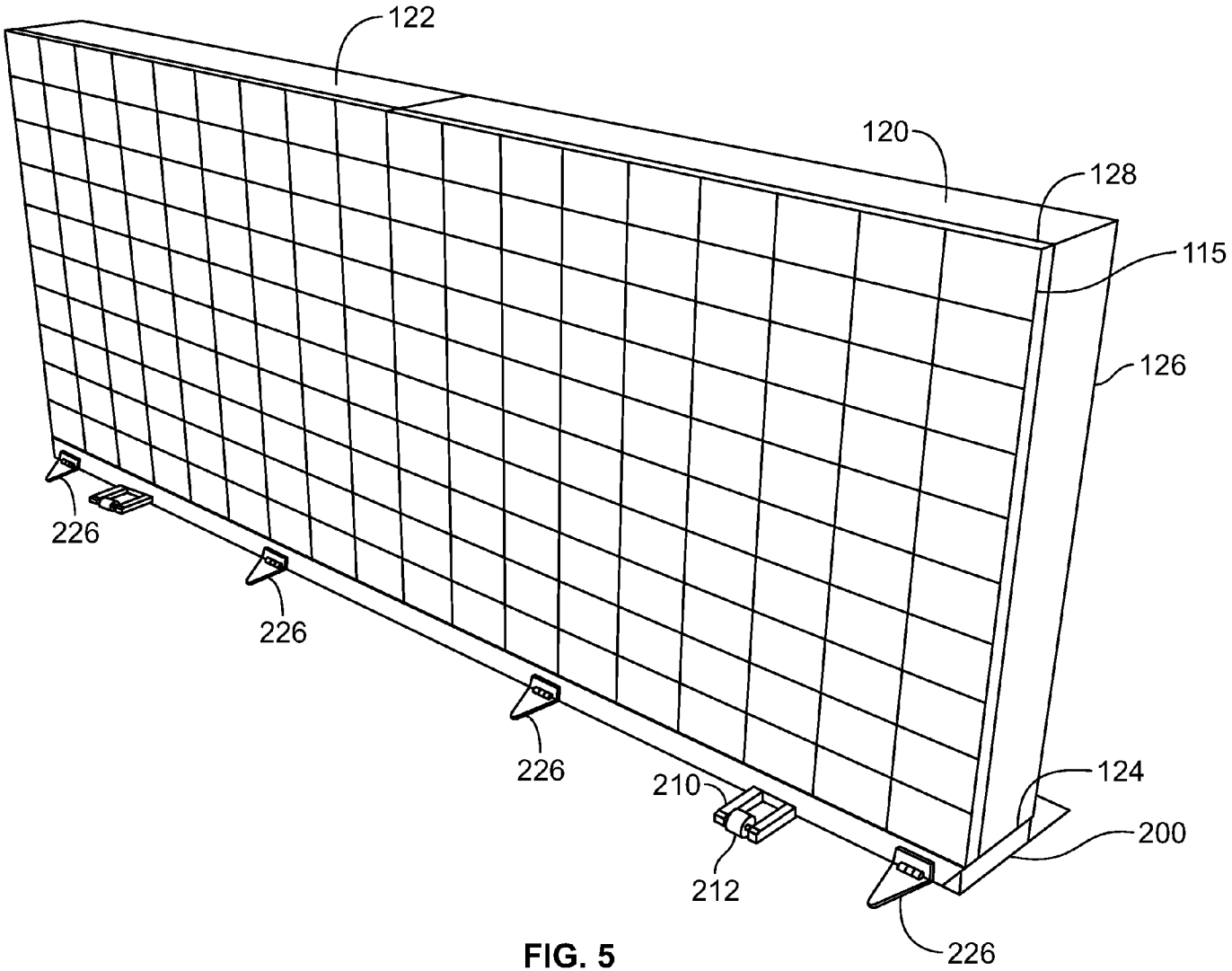
FIG. 5 is a perspective view of specific components of an LED Signage system in accordance with an embodiment of the invention.
Figure 6:
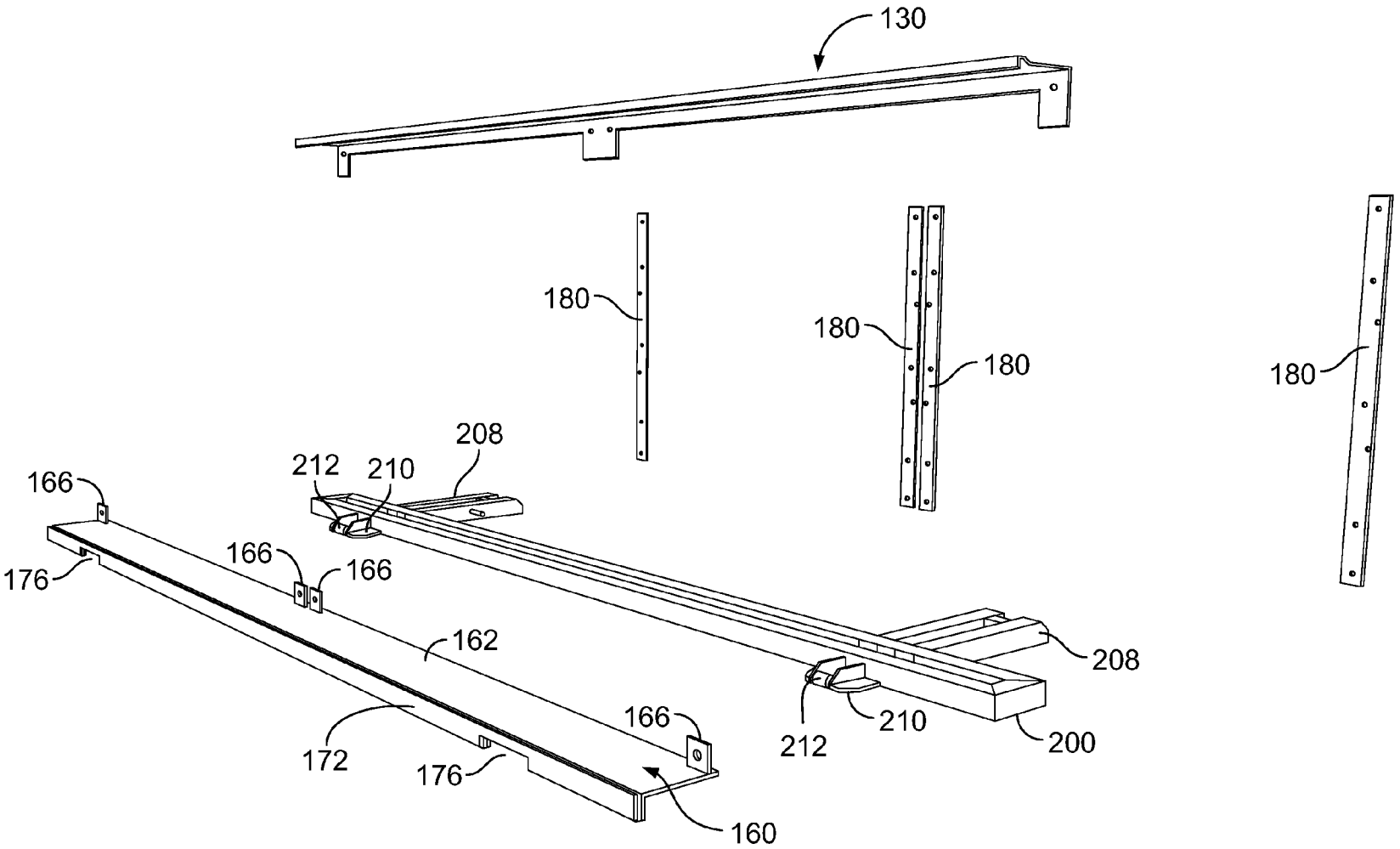
FIG. 6 is an exploded view of specific components of an LED Signage system in accordance with an embodiment of the invention.
Figure 7:
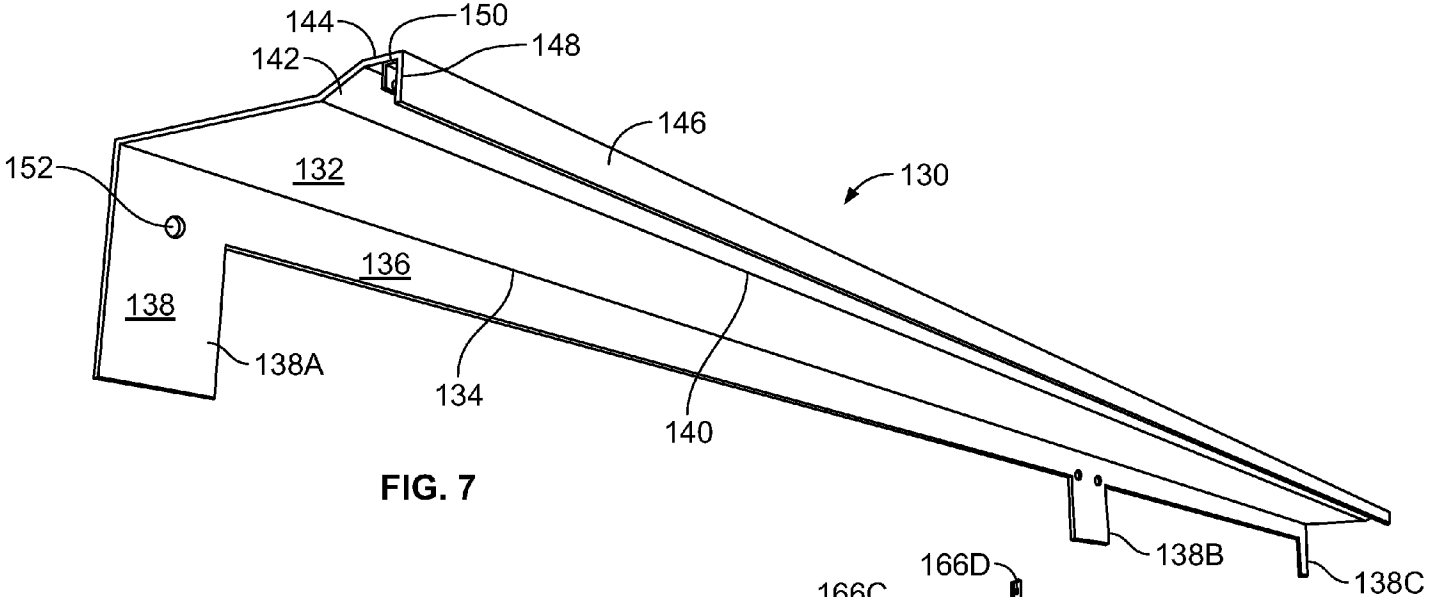
FIG. 7 is a perspective view of a top support plate used in an LED Signage system in accordance with an embodiment of the invention.
Figure 8:
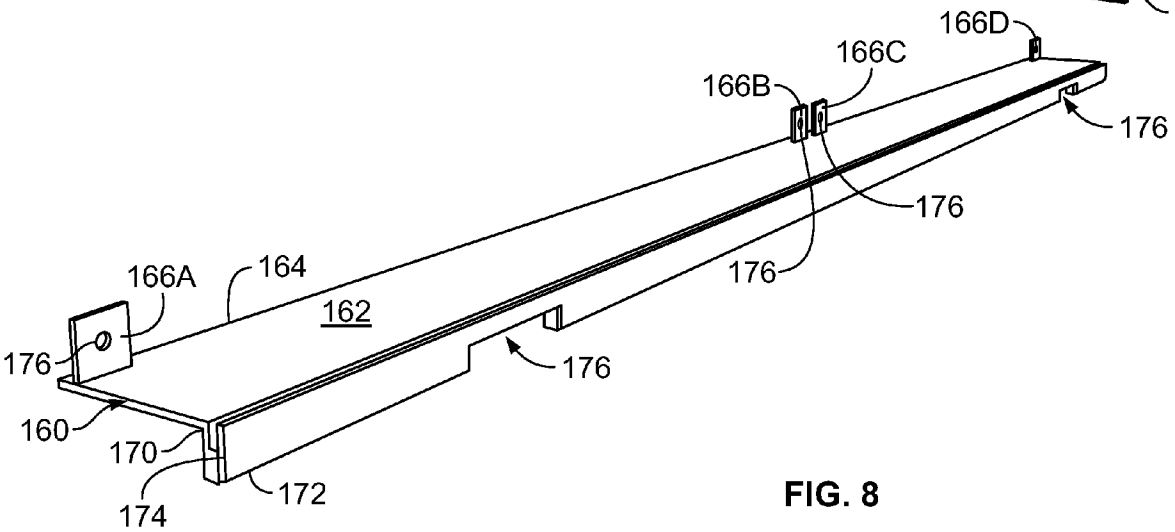
FIG. 8 is a perspective view of a bottom support plate used in an LED Signage system in accordance with an embodiment of the invention.
Figure 9:
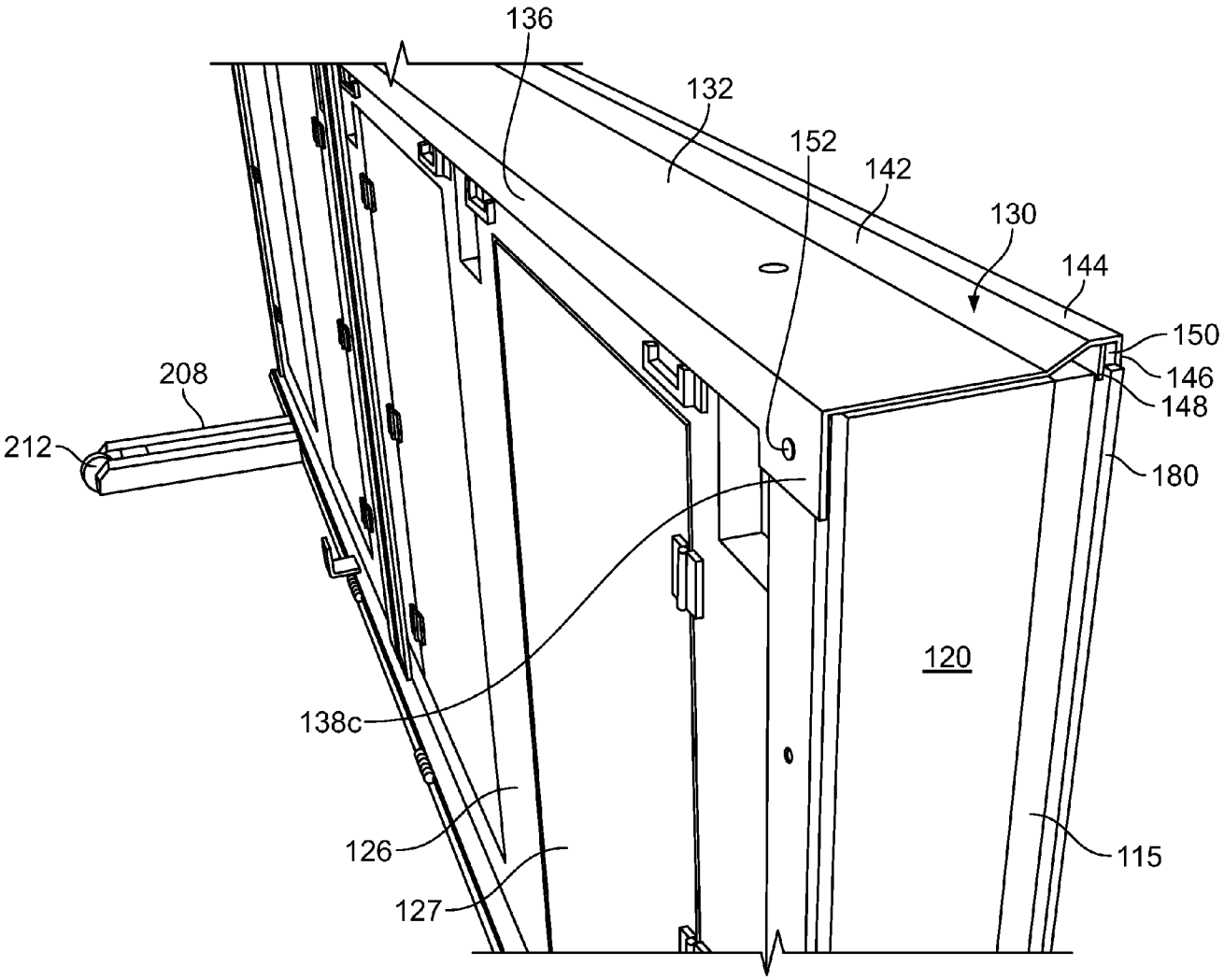
FIG. 9 is a partial side perspective view of an LED Signage system in accordance with an embodiment of the invention.
Figure 10:
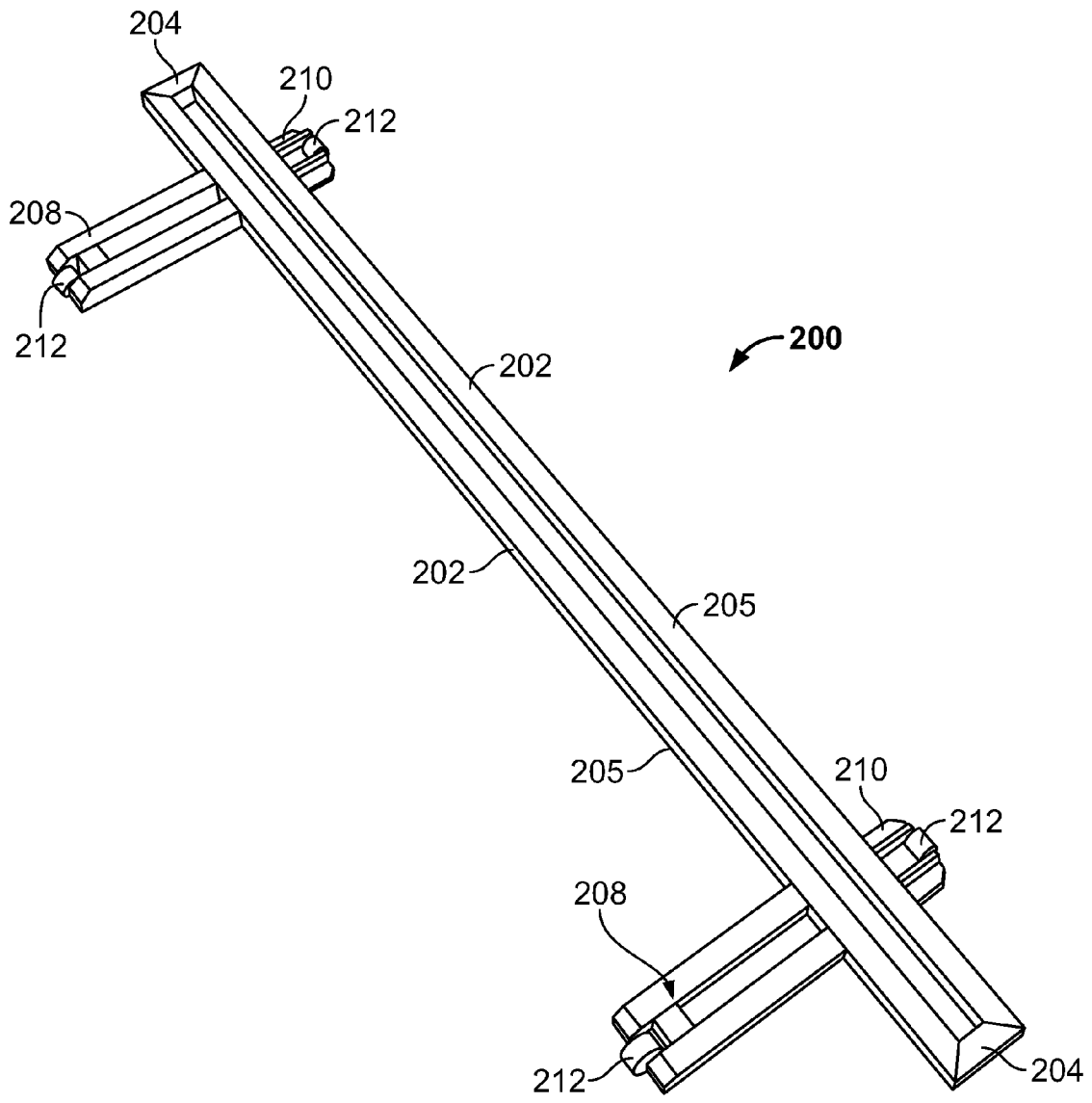
FIG. 10 is a perspective view of a base frame used in an LED Signage system in accordance with an embodiment of the invention.
Figure 11:
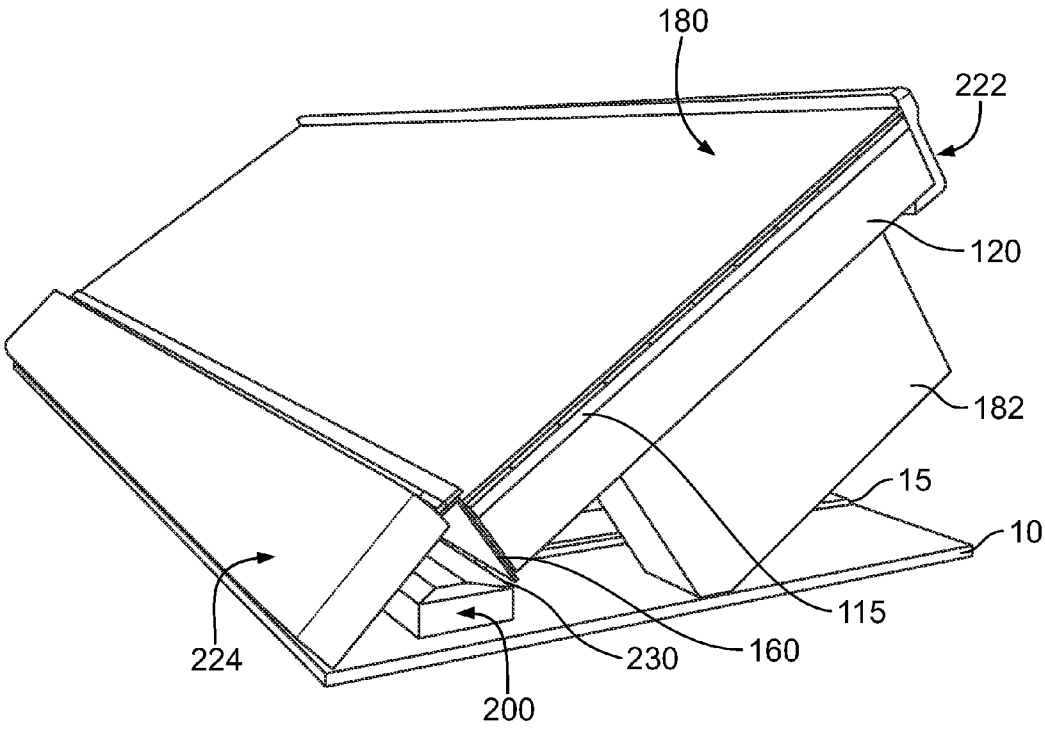
FIG. 11 is a perspective view of an LED Signage system in accordance with an embodiment of the invention in a collapsed position.
Figure 12:
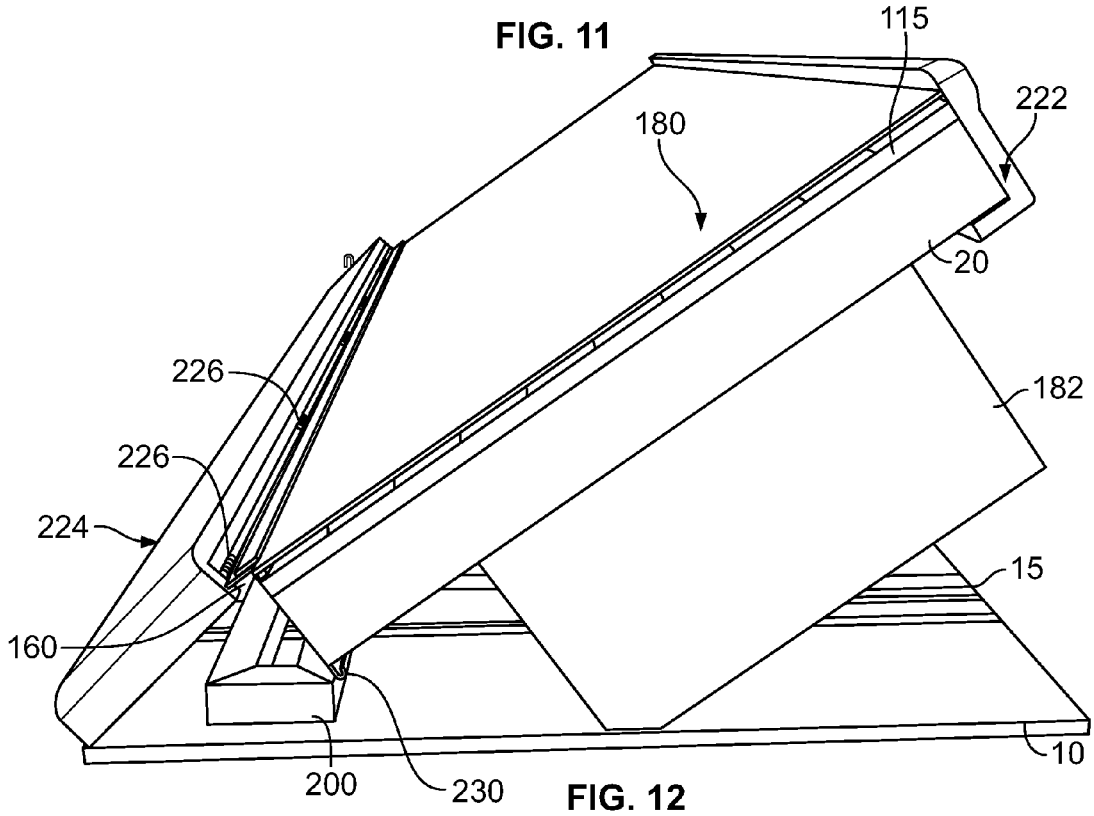
FIG. 12 is a perspective view of an LED Signage system in accordance with an embodiment of the invention in a collapsed position.

Referring now FIGS. 1 and 2 there is provided an LED Signage system referenced as 100 and that includes an LED Signage subassembly 110 secured to a frame subassembly 200. The Led Signage subassembly 110 includes an LED Screen 115 secured to a support cabinet 120. The cabinet 120 holds the electronics and provides access to the interior of the LED Signage for maintenance purposes. The cabinet 120 includes a top portion 122, a bottom portion 124, a rear portion 126 and a front portion 128. The rear portion 126 of the cabinet 126 includes access panels 127 to the interior. And as illustrated the LED Screen 115 is secured to the front portion 128 of the cabinet.

A top support plate 130 is secured along the top portion 122 of the cabinet, while a bottom support plate 160 is secured along the bottom portion 124 of the cabinet 120. The top and bottom support plates are constructed similarly but not necessarily identically. The top support plate 130 includes atop panel 132 that includes a rear edge 134 that terminates to a depending rear panel 136. The rear panel 136 further includes rear flanges 138 extending from the rear panel. Preferably there are three rear flanges 138*a*, 138*b*, and 138*c* separately extending at the ends and in the center of the rear panel 136. The top panel 132 also includes a front edge 140 terminating to an upwardly tapered panel 142 which then continues into an outwardly extending panel 144. The outwardly extending panel 144 ends to a downwardly depending first front panel 146. Positioned inwardly along a bottom interior portion of the outwardly extending panel 144 is an inwardly positioned downwardly depending second front panel 148 spaced apart from and adjacent the downwardly depending first front panel 146 to create a top channel 150 there between. Top panel mounting holes 152 are positioned along the rear panel 136 to mount the top support plate 130 to the cabinet 120.

Similarly constructed, the bottom support plate 160 includes a bottom panel 162 that includes a rear bottom edge 164 that terminates to rear upwardly extending flanges 166. There are preferably three to four rear upwardly extending flanges 166*a*, 166*b*, 166*c*, and 166*d* separately extending from the ends and the center of rear edge 164. The bottom panel 162 also includes a front bottom edge 170 terminating to a U-shaped bottom section 172, with its channel 174 defined to open towards the top channel 150. In addition, the U-shaped bottom section 172 includes a pair of notches 176 along the length of the section 172 to accommodate a portion of the collapsible fame subassembly 200 (as further described below). Bottom panel mounting holes 176 are positioned along the rear upwardly extending flanges 166 to mount the top support plate 130 to the cabinet 120.

When the top and bottom support plates as secured to the cabinet 120, by positioning the bottom portion 124 of the cabinet on to the bottom panel 162 and positioning the top panel 132 on to the top portion 122 of the cabinet, the channels (174 from the U-shaped bottom section 172 and 150 from the top channel) aligned to accommodate a safety shield 180 positioned in front of the LED Signage from the cabinet 120. In addition, the rear upwardly extending flanges 166 from the bottom support plate 160 and the downwardly extending rear flanges 138 from the top support plate 160 would be positioned against the rear portion 126 of the cabinet 120.

Rear brace strips 180 are aligned with the rear flanges (138 and 166) and secured to the flanges and cabinet. The rear brace strips 180 include a plurality of mounting holes to secure rear pads 182. The pads are optional to help brace and soften the collapse of the cabinet if it tips backwards.

The bottom support plate 160 and the cabinet 120 are secured to a base frame 200. The base frame 200 includes forward and rear edges 205 to align with the edges of the bottom support plate 160. The base frame 200 may include a pair of longitudinal members 202 extending the length of the bottom support plate 160 with a pair of end members 204 to create a rectangular boxed base frame, with the forward and rear edges 205 along the pair of longitudinal members 202. The base frame 200 further includes a pair of rearwardly extending arms 208 and a pair of forwardly extending arms 210. Each of the arms 208 and 210 include a roller 212 connected thereto. The pair of rearwardly extending arms 208 and the pair of forwardly extending arms 210 are preferably separately positioned towards the ends of the base frame 200.

The top support plate 160 may further include mounting holes 220 along the top panel 132 to mount a top pad 222 made of a form or similar material to help prevent damage and injury if the cabinet is impacted. In addition, the bottom support plate 160 may be secured to a base pad 224 made of a form or similar material to help prevent damage and injury if the cabinet is impacted. Preferably, the base pad 224 is secured by front hinges 226 to the U-shaped bottom section 172.

To further aid in collapsing the LED Signage system 100, the bottom support plate 160 is preferably secured to the frame assembly 200 by rear hinges 230 along the rear bottom edge 164 to the rear edge 205 of the frame assembly 200. In addition, the LED Signage system 100 can rest on a platform 10 that includes a track 15 for the rollers 212 that are secured to the pair of rearwardly extending arms 208 and pair of forwardly extending arms 210.

When assembled the LED Signage system 100 sits on the platform 10 and the rollers 212 on the track 15 absorbs the initial force when impacted, i.e. the LED Signage system 100 may roll and move with the initial impact. If the impact is hard enough, the center of gravity changes and the rear hinges 230 allows the LED Signage system 100 to collapse. Lastly, the LED Signage system 100 can be a module system allowing multiple LED Signage systems 100 to be placed side by side and interconnected through electronics and hardware. In this instance if one of the systems is impacted it has the ability to collapse away from the other systems.

From the foregoing and as mentioned above, it will be observed that numerous variations and modifications may be effected without departing from the spirit and scope of the novel concept of the invention. It is to be understood that no limitation with respect to the specific methods and apparatus illustrated herein is intended or should be inferred.

We claim:

1. An LED Signage system comprising:

an LED cabinet having a top cabinet portion, a bottom cabinet portion, a rear cabinet portion and a front cabinet portion, the LED cabinet further having an LED screen secured to the front cabinet portion;

a top support plate secured along the top cabinet portion and having a top channel aligned downwardly;

a bottom support plate secured along the bottom cabinet portion and having a bottom channel aligned upwardly towards the top channel;

rear brace strips secured against the rear cabinet portion and configured to secure thereto rear pads extending from the rear cabinet portion;

a base frame supporting the bottom support plate and thus the cabinet, the base frame having forward and rear base edges to align with edges along the bottom support plate, the base frame further having a pair of rearwardly extending arms and a pair of forwardly extending arms;

a roller connected to each of the pair of rearwardly extending arms and each of the pair of forwardly extending arms; and rear hinges positioned to secure the bottom support plate to the base frame, such that when an force impacts the LED Signage system the cabinet is configured to move at the rear hinges from an upright position resting on the base frame to a collapsed position and wherein when moving to the collapsed position, the rear pads help reduce damage to the cabinet.

2. The LED Signage system of claim 1 further comprising a platform having a pair of tracks, the platform configured to support the base frame and the pair of tracks configured to accommodate the rollers secured to the pair of rearwardly extending arms and secured to the pair of forwardly extending arms.

3. The LED Signage system of claim 1, wherein the top support plate includes:

a top panel having a rear edge and a front edge;

a rear panel depending from the rear edge, the rear panel further having a plurality of top rear flanges extending downwardly therefrom;

an upwardly tapered panel extending from the front edge of the top panel;

an outwardly extending panel further extending from the upwardly tapered panel; and a pair of downwardly dependent front panels extending from the outwardly extending panel and spaced apart from each other a predetermined distance to form the top channel there between.

4. The LED Signage system of claim 3, wherein the plurality of top rear flanges includes top rear flanges separately extending at ends of the rear panel and separately extending near a center of the rear panel.

5. The LED Signage system of claim 1, wherein the bottom support plate includes:

a bottom panel having a rear bottom edge and a front bottom edge;

a plurality of bottom rear flanges upwardly extending from the rear bottom edge of the bottom panel;

an U-shaped bottom section positioned from the front bottom edge of the bottom panel, and configured to define the bottom channel; and a pair of notches separately configured along the U-shaped bottom section.

6. The LED Signage system of claim 5, wherein the bottom rear flanges include a pair of bottom rear flanges separately positioned about ends of the rear bottom edge and at least one bottom rear flanges separately positioned about the center of the rear bottom edge.

7. The LED Signage system of claim 5, wherein the rearwardly extending arms are separately positioned in the pair of notches configured along the U-shaped bottom section of the bottom support panel.

8. The LED Signage system of claim 1 further comprising a safety shield positioned in the top and bottom channels front of the LED screen.

9. The LED Signage system of claim 1, wherein the base frame includes a pair of longitudinal member extending the length of the bottom support plate and a pair of end members secured to the pair of longitudinal members to define a rectangular shaped based frame with the forward and rear base edges defined along the pair of longitudinal members.

10. The LED Signage system of claim 9, wherein the pair of rearwardly extending arms and the pair of forwardly extending arms are separately positioned towards the end members of the base frame.

11. The LED Signage system of claim 1 further comprising a top pad secured to the top support plate.

12. The LED Signage system of claim 1 further comprising a base pad secured by a plurality of front hinges to a front edge of the bottom support plate.

13. An LED Signage system comprising:

an LED cabinet having a top cabinet portion, a bottom cabinet portion, a rear cabinet portion and a front cabinet portion, the LED cabinet further having an LED screen secured to the front cabinet portion;

a top support plate secured along the top cabinet portion and having a top channel aligned downwardly and further having a plurality of top rear flanges extending downwardly;

a bottom support plate secured along the bottom cabinet portion and having a bottom channel aligned upwardly towards the top channel and further having a plurality of bottom rear flanges extending upwardly;

rear brace strips secured against the rear cabinet portion, and wherein the rear brace strips are aligned and secured to the top and bottom rear flanges;

rear pads secured to the rear brace strips and extending away from the rear cabinet portion;

a base frame supporting the bottom support plate and thus the cabinet, the base frame having forward and rear base edges to align with edges along the bottom support plate, the base frame further having a pair of rearwardly extending arms and a pair of forwardly extending arms;

a roller connected to each of the pair of rearwardly extending arms and each of the pair of forwardly extending arms; and rear hinges positioned to secure the bottom support plate to the base frame, such that when an force impacts the LED Signage system the cabinet is configured to move at the rear hinges from an upright position resting on the base frame to a collapsed position and wherein when moving to the collapsed position, the rear pads help reduce damage to the cabinet.

14. The LED Signage system of claim 13 further comprising a platform having a pair of tracks, the platform configured to support the base frame and the pair of tracks configured to accommodate the rollers secured to the pair of rearwardly extending arms and secured to the pair of forwardly extending arms.

15. The LED Signage system of claim 13, wherein the top support plate includes:

a top panel having a rear edge and a front edge;

a rear panel depending from the rear edge, the plurality of top rear flanges extending downwardly from the rear panel;

an upwardly tapered panel extending from the front edge of the top panel;

an outwardly extending panel further extending from the upwardly tapered panel; and a pair of downwardly dependent front panels extending from the outwardly extending panel and spaced apart from each other a predetermined distance to form the top channel there between.

16. The LED Signage system of claim 13, wherein the bottom support plate includes:

a bottom panel having a rear bottom edge and a front bottom edge, wherein the plurality of bottom rear flanges upwardly extend from the rear bottom edge of the bottom panel;

an U-shaped bottom section positioned from the front bottom edge of the bottom panel, and configured to define the bottom channel; and a pair of notches separately configured along the U-shaped bottom section.

17. The LED Signage system of claim 13, wherein the rearwardly extending arms are separately positioned in the pair of notches configured along the U-shaped bottom section of the bottom support panel.

18. The LED Signage system of claim 13 further comprising a safety shield positioned in the top and bottom channels front of the LED screen.

19. The LED Signage system of claim 13, wherein the base frame includes a pair of longitudinal member extending the length of the bottom support plate and a pair of end members secured to the pair of longitudinal members to define a rectangular shaped based frame with the forward and rear base edges defined along the pair of longitudinal members.

20. The LED Signage system of claim 19, wherein the pair of rearwardly extending arms and the pair of forwardly extending arms are separately positioned towards the end members of the base frame.

21. The LED Signage system of claim 13 further comprising:

a top pad secured to the top support plate and/or a base pad secured by a plurality of front hinges to a front edge of the bottom support plate.

22. An LED Signage system comprising:

an LED cabinet having top, bottom, rear, and front cabinet surfaces, and further having an LED screen secured to the front cabinet surface;

top and bottom support plates, respectively secured along the top and bottom portions of the cabinet, each having a channel aligned towards each other and positioned about the front cabinet surfaces;

a safety screen positioned in the channels to help protect the LED screen a base frame supporting the bottom support plate and thus the cabinet, the base frame having forward and rear base edges to align with edges along the bottom support plate, the base frame further having a pair of rearwardly and a pair of forwardly extending arms;

a roller connected to each of the pair of rearwardly extending arms and each of the pair of forwardly extending arms; and rear hinges positioned to secure the bottom support plate to the base frame, such that when an force impacts the LED Signage system the cabinet is configured to move at the rear hinges from an upright position resting on the base frame to a collapsed position and wherein when moving to the collapsed position.

23. The LED Signage system of claim 22 further comprising rear pads secured to the rear cabinet surface to help reduce damage to the cabinet when the cabinet moves to a collapsed position.

24. The LED Signage system of claim 23 further comprising a platform having a pair of tracks, the platform configured to support the base frame and the pair of tracks configured to accommodate the rollers secured to the pair of rearwardly extending arms and secured to the pair of forwardly extending arms.

25. The LED Signage system of claim 24 further comprising a top pad secured to the top support plate and/or a base pad secured by a plurality of front hinges to a front edge of the bottom support plate.

26. An LED Signage system comprising:

an LED cabinet;

top and bottom support plates secured along top and bottom surfaces defined by the cabinet, the top and bottom support plates each have a channel aligned towards each other;

a safety screen received in the channels to protect a front surface of the LED cabinet;

a base frame supporting the bottom support plate and having pairs of rearwardly and forwardly extending arms, each arm having a roller thereon;

rear hinges secure the bottom support plate to the base frame; and a platform with tracks configured to support the base frame and rollers, such that when a force impacts the system the cabinet is configured to move about the track and/or at the rear hinges from an upright position to a collapsed position.

27. The LED Signage system of claim 26, further comprising:

one or more pads positioned along the top support plate and/or positioned along a rear surface of the cabinet and/or secured by hinges to a front edge of the bottom support plate to help protect the system if collapsed from an impact.

* * * * *